US010256057B2

(12) United States Patent
Clementson

(10) Patent No.: US 10,256,057 B2
(45) Date of Patent: Apr. 9, 2019

(54) MECHANICAL STRUCTURE FOR BUTTON ON SATELLITE MICROPHONE

(71) Applicant: DOLBY LABORATORIES LICENSING CORPORATION, San Francisco, CA (US)

(72) Inventor: David Clementson, Palo Alto, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 15/554,393

(22) PCT Filed: Mar. 2, 2016

(86) PCT No.: PCT/US2016/020457

§ 371 (c)(1),
(2) Date: Aug. 29, 2017

(87) PCT Pub. No.: WO2016/141062

PCT Pub. Date: Sep. 9, 2016

(65) Prior Publication Data

US 2018/0174777 A1 Jun. 21, 2018

Related U.S. Application Data

(60) Provisional application No. 62/128,919, filed on Mar. 5, 2015.

(51) Int. Cl.

| | |
|---|---|
| ***H04R 1/08*** | (2006.01) |
| ***H01H 13/02*** | (2006.01) |
| ***H01H 13/04*** | (2006.01) |
| ***H01H 13/14*** | (2006.01) |

(52) U.S. Cl.

CPC ..... *H01H 13/14* (2013.01); *H01H 13/023* (2013.01); *H04R 1/08* (2013.01); *H01H 13/04* (2013.01); *H01H 2215/03* (2013.01); *H01H 2219/06* (2013.01); *H01H 2219/0622* (2013.01); *H01H 2221/082* (2013.01); *H01H 2231/022* (2013.01)

(58) Field of Classification Search

CPC .. H04R 1/02; H01H 13/023; H01H 2219/062; H01H 9/0235

USPC ..... 379/388.02; 362/86

See application file for complete search history.

(56) References Cited

U.S. PATENT DOCUMENTS

| | | | |
|---|---|---|---|
| 3,811,024 | A | 5/1974 | Sevigny |
| 4,618,754 | A | 10/1986 | Gross |

(Continued)

FOREIGN PATENT DOCUMENTS

| | | |
|---|---|---|
| CN | 1312948 | 4/2007 |
| CN | 101996801 | 3/2011 |

(Continued)

*Primary Examiner* — Vanessa Girardi

(57) ABSTRACT

An apparatus may include: a stationary module; a movable module having an outer surface and a substrate; a tactile switch secured on a first side of the substrate; a light indicator secured on a second side of the substrate, the first side and the second side being opposing sides of the substrate, etc. The movable module is configured to generate a spatial displacement relative to the stationary module along a spatial direction in response to a physical force exerted on the outer surface along the spatial direction.

17 Claims, 9 Drawing Sheets

(56) References Cited

U.S. PATENT DOCUMENTS

| | | | | |
|---|---|---|---|---|
| 4,851,626 | A * | 7/1989 | Nagashima | H01H 13/52 200/513 |
| 5,373,132 | A | 12/1994 | Achermann | |
| 6,800,819 | B2 | 10/2004 | Sato | |
| 6,884,948 | B2 * | 4/2005 | Gotoh | B60K 37/06 200/332 |
| 6,984,797 | B2 | 1/2006 | Morita | |
| 7,046,136 | B2 | 5/2006 | Sugimoto | |
| 7,183,634 | B2 | 2/2007 | Lee | |
| 7,262,374 | B2 | 8/2007 | Takatsuka | |
| 7,355,137 | B2 | 4/2008 | Kawasaki | |
| 7,825,345 | B1 | 11/2010 | Kano | |
| 7,960,665 | B2 | 6/2011 | Sakai | |
| 7,994,447 | B2 | 8/2011 | Sakai | |
| 8,044,313 | B2 | 10/2011 | Yamamoto | |
| 8,457,614 | B2 * | 6/2013 | Bernard | H04M 1/6033 455/416 |
| 8,829,378 | B2 | 9/2014 | Villain | |
| 2014/0144765 | A1 | 5/2014 | Lee | |

FOREIGN PATENT DOCUMENTS

| | | |
|---|---|---|
| EP | 1091374 | 4/2001 |
| JP | 2006-140048 | 6/2006 |
| JP | 2007-141503 | 6/2007 |
| JP | 2007-194092 | 8/2007 |
| KR | 10-0453126 | 10/2004 |
| KR | 10-0483990 | 4/2005 |
| KR | 2009-0050470 | 11/2007 |
| WO | 2014-197697 | 12/2014 |

* cited by examiner

MECHANICAL STRUCTURE FOR BUTTON ON SATELLITE MICROPHONE

CROSS-REFERENCE TO RELATED APPLICATIONS

This application claims priority to U.S. Provisional Patent Application No. 62/128,919, filed on Mar. 5, 2015, which is hereby incorporated by reference herein. This application is also related to International Patent Application No. PCT/US2014/041096, filed on Jun. 5, 2014. International Patent Application No. PCT/US2014/041096 claims priority to U.S. Provisional Application No. 61/832,032, filed on Jun. 6, 2013, each of which are incorporated by reference herein.

TECHNOLOGY

The present invention relates generally to buttons on audio and other electronic devices. More particularly, embodiments of the present invention relates to structures for buttons on audio devices such as satellite microphones, etc.

BACKGROUND

A conference phone device typically includes built-in microphones to capture voices from conference participants. The built-in microphones may have a strong bias to pick up voices of those conference participants who are located near the built-in microphones. In some instances, external microphone devices such as satellite microphones, etc., can be used in conjunction with the conference phone device to capture voices at various distances from the conference phone device.

A satellite microphone may include a mute button and a light emitting diode (LED) on its outer surface. When the satellite microphone is muted by a conference participant pressing the mute button, the LED may emit light. To reduce interference with voice capturing, the mute button and the LED may be small. Dexterity may be required to locate and press the small mute button in an assured manner to mute the call and cause the small LED to glow. Since an LED is typically small and geometrically confined, even nearby conference participants may fail to notice the glowing of the LED, depending on angles and locations of the conference participants relative to the LED, etc.

The approaches described in this section are approaches that could be pursued, but not necessarily approaches that have been previously conceived or pursued. Therefore, unless otherwise indicated, it should not be assumed that any of the approaches described in this section qualify as prior art merely by virtue of their inclusion in this section. Similarly, issues identified with respect to one or more approaches should not assume to have been recognized in any prior art on the basis of this section, unless otherwise indicated.

BRIEF DESCRIPTION OF DRAWINGS

The present invention is illustrated by way of example, and not by way of limitation, in the figures of the accompanying drawings and in which like reference numerals refer to similar elements and in which.

DESCRIPTION OF EXAMPLE EMBODIMENTS

Figure 1A:
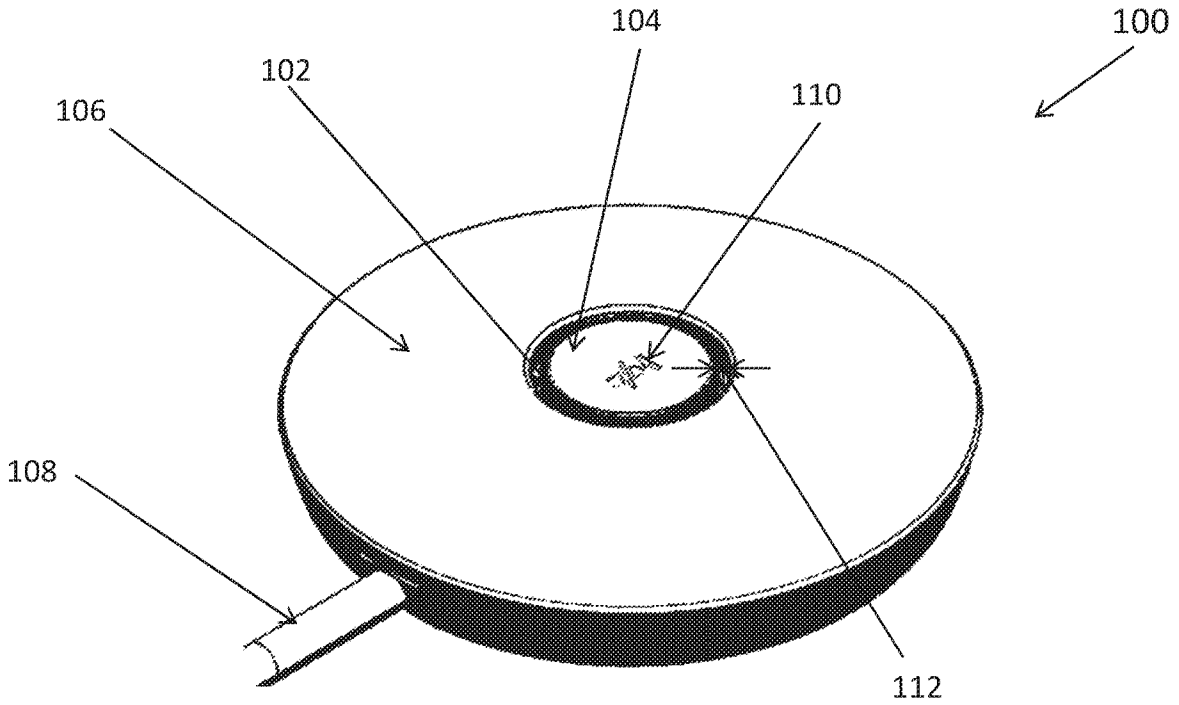
FIG. 1A and FIG. 1B illustrate example views of an external microphone device.

Example embodiments, which relate to buttons on audio and other electronic devices, are described herein. In the following description, for the purposes of explanation, numerous specific details are set forth in order to provide a thorough understanding of the present invention. It will be apparent, however, that the present invention may be practiced without these specific details. In other instances, well-known structures and devices are not described in exhaustive detail, in order to avoid unnecessarily occluding, obscuring, or obfuscating the present invention.

Example embodiments are described herein according to the following outline:

1. GENERAL OVERVIEW
2. STRUCTURAL OVERVIEW
3. EXAMPLE VIEWS OF EXTERNAL MICROPHONE DEVICE
4. MOVABLE AND STATIONARY MODULES
5. LIGHT INDICATOR
6. DIVERSITY IN MICROPHONES
7. EXAMPLE EMBODIMENTS
8. IMPLEMENTATION MECHANISMS—HARDWARE OVERVIEW
9. EQUIVALENTS, EXTENSIONS, ALTERNATIVES AND MISCELLANEOUS

1. General Overview

This overview presents a basic description of some aspects of an example embodiment of the present invention. It should be noted that this overview is not an extensive or exhaustive summary of aspects of the example embodiment. Moreover, it should be noted that this overview is not intended to be understood as identifying any particularly significant aspects or elements of the example embodiment, nor as delineating any scope of the example embodiment in particular, nor the invention in general. This overview merely presents some concepts that relate to the example embodiment in a condensed and simplified format, and should be understood as merely a conceptual prelude to a more detailed description of example embodiments that follows below.

Audio devices may achieve optimal results when these systems remain unobstructed. For example, the quality of sound captured by a satellite microphone may be significantly reduced if microphone elements in the satellite microphone is occluded for certain locations or angles. The quality of sound may be optimal when the inclusion of other components, such as a light indicator, a mute button, etc, within the satellite microphone do not obstruct the microphone elements.

A device (e.g., a satellite microphone, etc.) as described herein may include an inner module and an outer module that substantially surrounds a perimeter of the inner module. The outer module may be a stationary module, whereas the inner module may be a movable module whose motion relative to the stationary module can be actuated, by a user exerting a physical force or pressure (e.g., a downward physical force, a downward physical pressure, etc.) on an outer surface (e.g., an upward facing surface, an operational surface, etc.) of the movable module. The outer surface of the movable module may be a part of an overall outer surface (e.g., exterior surfaces of a chassis, exposed to users, viewable to users in ordinary operations, etc.) of the device.

The movable module may include a substrate such as a printed circuit board (PCB), etc. A tactile switch such as a push button switch, etc., may be mounted on or otherwise secured to the PCB on one side (e.g., a downward facing side, etc.) in an interior region (e.g., not directly accessible to a user of the device, etc.) of the movable module. In response to the physical forces or pressures on an operational surface such as the outer surface of the movable module, a plunger in the tactile switch can be moved/rotated to cause the tactile switch to be engaged/activated, for example, in order to mute or unmute (e.g., microphone elements in, etc.) the device.

A light indicator may be incorporated by a device as described herein. The light indicator may be a light pipe mounted on or otherwise secured to the PCB on a side that is opposite to the side on which the tactile switch is mounted. One or more light emitters may also be mounted on the PCB inside the inner module. The light emitters may inject light through a light receiving surface portion of the light indicator into a light transmission medium inside of the light indicator. In some embodiments, the light from the light emitters may form a light cone originated from the light emitters and centered around a normal direction to the light receiving surface portion of the light indicator. The light receiving surface portion of the light indicator may be parallel or substantially parallel (e.g., within a small tolerance of three degrees, five degrees, a fraction of degree, etc.) to a planar surface of the PCB.

The light transmission medium of the light indicator may transport or guide the light injected by the light emitters to eventually illuminate an edge of the light indicator on the outer surface of the device. In some embodiments, the edge of the light indicator has a diffusive surface and has an elongated shape that traverses a substantial portion of a boundary on the outer surface of the device between the outer surface of the movable module and the outer surface of the stationary module. The edge of the light indicator may be exposed to users, viewable to users in operations, etc., as a visible part of the light indicator. The diffusive surface may cause the edge of the light indicator to give off a uniform glow effect when the light indicator receives light from the light emitters.

In some embodiments, the light indicator may be built into the inner module. The light indicator as described herein may be added to the device without significantly impacting or increasing the vertical footprint (e.g., vertical profile, vertical dimension, etc.) of the device. More specifically, in some embodiments, a device as described herein may assume a relatively small vertical dimension as compared with its horizontal dimension, in order to make the device similar to other devices in operation, allow acoustic elements such as microphone elements, etc., to better perform acoustic transducing functions, sound capturing functions, sound rendering functions, etc.

A light indicator as described herein can be used by a device to convey information with respect to one or more operations, one or more features, one or more states, etc., of the device. For a satellite microphone, the light indicator may be used to identify whether the satellite microphone is (or a conference phone device and all its subtending microphones are) muted or not. Due to the positioning of, and a relatively large spatial area traversed by, the (e.g., elongated, etc.) edge of the light indicator, the light indicator may be clearly visible through the edge at a wide range of azimuths and altitudes within a room.

Various modifications to the preferred embodiments and the generic principles and features described herein will be readily apparent to those skilled in the art. Thus, the disclosure is not intended to be limited to the embodiments shown, but is to be accorded the widest scope consistent with the principles and features described herein.

2. Structural Overview

According to techniques described herein, an edge (e.g., an elongated edge that forms a circle, an elongated edge that forms a curve, a multi-segmented edge, etc.) of a light indicator is built into an inner module in an audio or other electronic device. As used herein, an inner module of a device may have one or more outer surfaces that are exposed to users in operations, normal positioning, etc., of the device. The device may or may not be affixed to (or secured to) an immovable structure. In some embodiments, the device is portable at least within a certain space such as a portion of a room, etc. For example, the device (e.g., a satellite microphone, etc.) may be moved around on a surface such as that of a table, etc.

A light indicator as described herein may comprise one or more of light transmission media, and may assume any of a wide variety of shapes such as a ring shape, a tube shape, a tubular shape, a dish shape, a curved shape, etc. As used herein, a light transmission medium may refer to a light transparent medium, a light diffusive medium, a light distribution medium, etc. In some embodiments, a light transmission medium as described herein is made of a relatively dense (e.g., as compared with air, etc.) optical material, and is not made of air or vacuum.

Custom designed shapes, aspect ratios, etc., may be used for the light indicator and may conform to the contours (e.g., boundaries, etc.) of other physical components (e.g., mechanical support components, etc.) between which the light indicator is disposed or interposed. The light indicator, or the light transmission media therein, may transport or guide light from a light source (e.g., a light emitter, etc.) along optical paths to an exit point (e.g., an edge of the light indicator on the outer surface of the device, etc.) where the light is scattered to create a "glow" effect.

Modules in a device as described herein may be any device component, system, or subsystem that performs a particular function or a particular set of functions. In some embodiments, the device that incorporates a light indicator as described herein may comprise an outer module that is stationary (e.g., in operations of the device, except perhaps when the device is being ported from one location to another, etc.), an inner module that is movable relative to the outer module when a physical force is applied to an operational surface (e.g., an outer surface, etc.) of the inner module, etc.

The stationary module may include microphone elements, microphone housings, microphone support structures, resilient supports, rigid supports, dampers, etc. The movable module may include a switch, such as a tactile switch, etc., that causes a particular function or set of functions of the device to be performed in direct response to a user interaction with the movable module such as an exertion of a physical force on any, some or all locations of the outer surface of the movable module, etc. For example, the movable module may be used as a high-end call mute/unmute button (or any other button for functions other than muting or unmuting microphones) that, when pressed, toggles between muting and unmuting the device, or a conference phone device and external microphone devices (e.g., satellite microphones, etc.) operating in conjunction with the conference phone device, etc., during a conference call.

The movable module may be configured to generate simultaneously a tactile feedback, an audible feedback, an illumination state change feedback (e.g., from not being illuminated to being illuminated, from being illuminated with one color to being illuminated with a different color, etc.), etc., to a user when the user presses on an (e.g., upward facing, etc.) outer surface of the movable module to cause a particular function or set of functions of the device to be performed. These simultaneous feedbacks are directed to multiple sensory pathways of the user, and allow the user to perceive the device as a high-end, high quality device.

In some embodiments, a light indicator as described herein provides an elongated circular edge on an outer surface of a device such as a satellite microphone, etc. "Circular" as used herein may refer to any shape with rounded edges and no corners. A circular shape of the elongated edge may also be visibly segmented. Example shapes of an elongated circular edge of a light indicator may include, without limitation, circles, ovals, ellipses, broken circles, broken ovals, broken ellipses, etc. An elongated circular edge of a light indicator may be advantageous in many implementations. For example, such an edge may facilitate a relatively even distribution of light and allows for a relatively uniform glow. In addition, the circular shape may be relatively easily visible from a wide range of azimuths and angles as there are no corners that may obstruct a view of the light indicator.

A circular design may also be advantageous in some audio devices. To minimize the vertical profile of a device, microphone elements may be placed in an outer module of the device. A mute/unmute button may be implemented with an inner module of the device placed in a central depression formed by the contours of the outer module of the device. An edge of a light indicator described herein may be interposed between outer surfaces (e.g., upward facing surfaces, etc.) of the outer and inner modules. For a circular shaped device in an example implementation, the form of the light indicator, as represented by the shape of the edge of the light indicator on the outer surface of the device, becomes a circular ring or "halo" around an edge of the inner module that acts as a mute/unmute button operable by a user.

3. Example Views of External Microphone Device

Figure 1B:
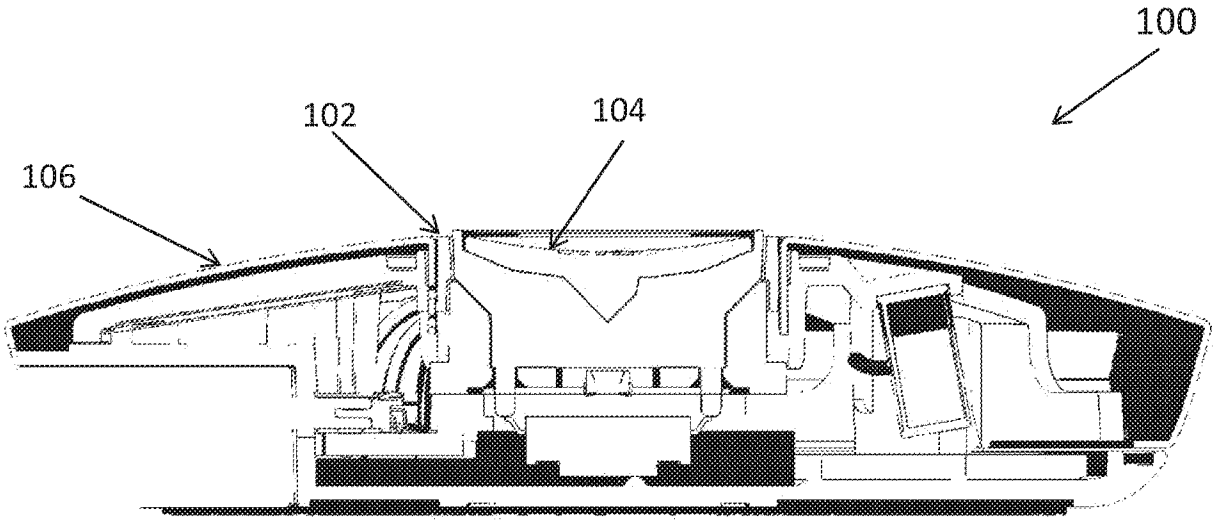

FIG. 1A illustrates a general view of an external microphone device 100 (e.g., a satellite microphone, etc.) with an edge (e.g., a circular edge, etc.) of a light indicator 102 interposed between an outer surface (e.g., an upward facing surface, etc.) of an inner module 104 and an outer surface (e.g., an upward facing surface, etc.) of an outer module 106. FIG. 1B illustrates an example cross-sectional view of the device (100). With the device fully assembled, the edge (e.g., a terminal edge, etc.) of the light indicator (102) is visible. The remaining portions of the light indicator (102) other than the edge of the light indicator (102) may be below the surface of the device (100) and hidden from view. The edge of the light indicator (102) substantially traverses a boundary (or border) between the inner module (104) and the outer module (106) thereby forming a light ring around the inner module (104) as viewed by a user of the device (100). In some embodiments, from an overhead view, the (e.g., circular, etc.) edge of the light indicator (102), the inner module (104), and the outer module (106) are (e.g., approximately, etc.) concentric to one another, sharing approximately the same central (e.g., vertically oriented, etc.) axis.

The outer module (106) may include one or more microphone elements, such as one or more of electret microphones, condensor microphones, piezoelectric transducers (e.g., audio transducer with piezoelectric diaphragm, etc.), microphones of other types, etc. Although the outer module (106) and the edge of the light indicator (102) are depicted as substantially encircling the inner module (104), other shapes are also possible. For example, the outer module (106) may form a square, triangle, or otherwise substantially surround an edge or a perimeter of the inner module (104), depending on the particular implementation. The outer module (106) and the edge of the light indicator (102) may completely surround the inner module (104).

Additionally, optionally, or alternatively, the edge of the light indicator (102) and/or the outer module (106) may be segmented resulting in breaks in the circle. "Substantially surrounded" may thus refer, without limitation, to a complete surrounding or a segmented surrounding with one or more gaps. In a non-limiting example, the edge of the light indicator (102), which is configured to be illuminated in one or more light indicator states, is uniform in width (e.g., 112, etc.) across length (e.g., the perimetric length, etc.) of the edge of the light indicator (102).

The device (100) may or may not be affixed to or otherwise secured to a spatial position such as a surface of a table, etc. In some embodiments, the device (100) may be movably placed on top of a surface of a fixture or a furniture piece.

The inner module (104) may be movable in relation to the outer module (106) in response to a user pressing (or exerting a physical force) at any, some or all locations of the outer surface of the inner module (104). The inner module (104) may internally comprise a switch (e.g., a tactile switch, a push-button switch, etc.) that can be activated or engaged in response to the motion of the inner module (104) relative to the outer module (106). In embodiments in which the device (100) is, the activation of the switch inside the inner module (104), as caused by a spatial displacement of the inner module in response to a user exerting a physical force on the outer surface of the inner module (104), may mute or unmute the device (100). Additionally, optionally, or alternatively, the activation of the switch inside the inner module (104) may mute or unmute microphones in some or all of one or more devices that include but not limited to only the device (100), such as one or more of conference phone devices, external microphone devices, media devices, etc.

In some embodiments, the operational surface (e.g., the outer surface, etc.) of the inner module on which the user can exert physical forces to cause activations of the switch in the inner module may comprise a graphic indicator 110 such as an icon for a mute/unmute function of the device (100), etc.

Additionally, optionally, or alternatively, the device (100) may comprise one or more cables 108 (e.g., electric cables, power cables, audio cables, video cables, data connection cables, etc.) that can be used to connect the device (100) with one or more other devices such as a conference speaker phone, a central console, etc. In some embodiments, the device (100) may implement a device controller, a logic unit, etc., for example, on a PCB on which the light indicator, the tactile switch, etc., are mounted. One or more of signals (e.g., control signals, audio signals, video signals, etc.), messages, raw data, processed data, commands, requests, responses, controls, status indications, etc., may be communicated and exchanged between the device (100) and the other devices through the cables (108). For example, a conference speaker phone that operates in conjunction with the device (100) may receive audio signals captured by microphone elements in the outer module (106) through the cables (108). One or both of the conference speaker phone and the device (100) may receive indications, signals, etc., related to switch activations in the inner module (104).

In some embodiments, the device (100) may have an exterior design that is similar to that of another device. For example, in some of the embodiments in which the device (100) is a satellite microphone to a conference speaker device, the device (100) may implement an exterior design that resembles that of the conference speaker. The device (100) and the conference speaker device, possibly of different sizes, may both comprise inner and outer modules whose outer surfaces are separated by an elongated circular edge of a light indicator. In some embodiments, an edge of a light indicator, which is a visible part of the light indicator may be within a visible outer surface of a module. In some embodiments, the device (100) may comprise a light ring represented by the elongated circular edge that is of a sufficiently large diameter, for example, comparable to a diameter of a light ring implemented on another device such as the conference speaker device in the present example.

4. Movable and Stationary Modules

Figure 2A:
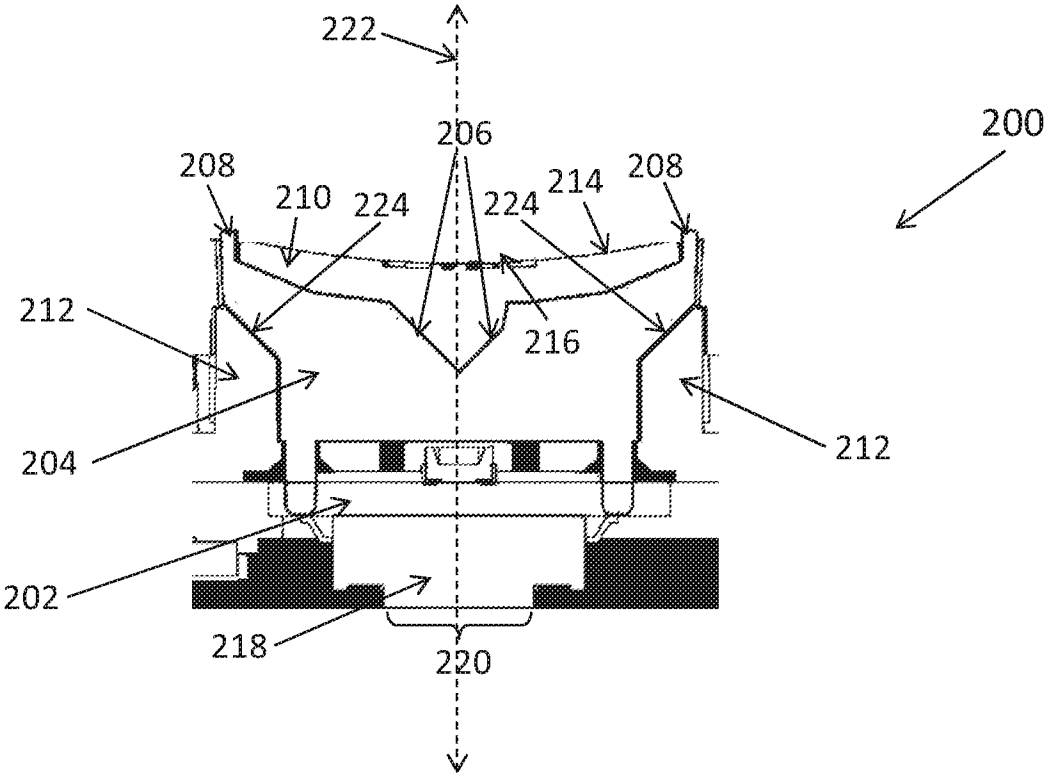
FIG. 2A illustrates an example movable module.

FIG. 2A illustrates an example movable module 200. In some embodiments, the movable module (200) may be used as an inner module (e.g., 104 of FIG. 1A, etc.) of a device (e.g., 100 of FIG. 1A, etc.) that at least in part incorporates a light indicator (e.g., 102 of FIG. 1A, etc.) as described herein. The movable module (200) comprises a PCB 202.

On the upper surface of the PCB (202) as shown in FIG. 2A is a light indicator 204, which may be the same as 102 of FIG. 1A. In some embodiments, the light indicator (204) is mounted on, or otherwise secured to the PCB (202). The light indicator (204) may comprise any of a wide variety of light diffusive materials, light transmissive materials, etc. For example, the light indicator (204) may comprise a (e.g., dense, solid state, liquid, etc.) light transmissive material such as resin, glass, etc. Additionally, optionally, or alternatively, the light indicator (204) can be provided with at least one or more internal light reflective surfaces (e.g., 206, 224, etc.) and a (e.g., light diffusive, etc.) edge 208. The internal light reflective surfaces (e.g., 206, 224, etc.) may, but are not limited to only, comprise one or more first internal light reflective surfaces 206, one or more second internal light reflective surfaces 224, etc. These reflective surfaces (e.g., 206, 224, etc.) may be configured (in terms of refractive index, geometry, light incident angles, etc.) to preserve and propagate light within the light transmissive media of the light indicator (204) until the light reaches and illuminates the edge (208) to give off a (e.g., diffusive, uniform, etc.) glow viewable by users of the device that incorporates the movable module (200). In some embodiments, the first internal light reflective surfaces (206) may form a contiguous surface centered around a vertical axis 222. The edge (208) may be the uppermost part, as shown in FIG. 2A, of the light indicator (204). In some embodiments, the edge (208) is an externally-visible part of the light indicator (204), while other parts of the light indicator (204) are below an outer surface of the movable module (200). As viewed from above in FIG. 2A, the edge (208) may form a light ring in illuminated states.

The light indicator (204) may be interposed between a first assembly part 210 and a second assembly part 212. Any of a wide variety of (e.g., solid, metallic, non-metallic, alloy, plastics, resin, natural, synthetic, etc.) materials can be used to make one or both of the first assembly part (210) and the second assembly part (212). In some embodiments, the first assembly part (210) and/or the second assembly part (212) may be made of zinc, and may comprise one or more of light reflective surfaces, light diffusive surfaces, light recycling surfaces, etc., to recycle or recirculate light into the light indicator (204). In some embodiments, one or more surface portions of the light indicator (204) coincide with one or more surface portions of one or both of the first assembly part (210) and the second assembly part (212). In some embodiments, one or more surface portions of the light indicator (204) may be affixed to one or more surface portions of one or both of the first assembly part (210) and the second assembly part (212), for example, with adhesive materials, adhesive tapes, etc. Additionally, optionally, or alternatively, the second assembly part (212) may be mounted on (e.g., screwed to, etc.) a support structure, a base structure, etc., as provided with a physical chassis, a physical housing, a physical side covering, a physical side enclosure, etc., of the movable module (200).

In some embodiments, the first assembly part (210) represents a cap comprising an operational surface 214 on which a physical force or pressure can be exerted by a user. For example, the operational surface (214) can be an upward facing outer surface of the first assembly part (210). In some embodiments, the operational surface (214) is a concave surface with which a spatial void 216 may be formed above the first assembly part (210). In some embodiments, the operational surface (214) comprises one or more features to indicate one or more functions, operations, etc., that can be performed by a user pressing on the operational surface (214). Examples of such features may include, but are not limited to only, any of: etched icons, printed icons, etc.

On the lower surface of the PCB (202) as shown in FIG. 2A is a downward-facing (e.g., tactile, etc.) switch 218. The separation of the switch (218) and the light indicator (204) under techniques as described herein facilitate use of, and serve to lower cost with, any of a wide variety of switches including, but not limited to only, any of (e.g., off-the-shelf, specially designed, etc.) tactile switches, push-button switches, leaf switches, etc. At the same time, these techniques facilitate adoption of, and enhance flexibility in, any of a wide variety of designs, shapes, etc., with respect to various parts separated from the switch (218) such as the shape of the light transmissive medium in the light indicator (204), the second assembly part (212), the first assembly part (210), the operational surface (214), the spatial void (216), the edge (208) of the light indicator (204), the light reflective surfaces (206), a graphic indicator (e.g., 110 of FIG. 1A, etc.) on the operational surface (214), etc. In some embodiments, the switch (218) comprises a second operational surface 220 on which a second physical force or pressure can be exerted by a contact between the second operational surface (220) of the switch (218) and a portion of a stationary module, the latter of which may be a part of an outer module 106 of FIG. 1A, a part of a stationary module in a device that also includes the movable module (200), etc.

Figure 2B:
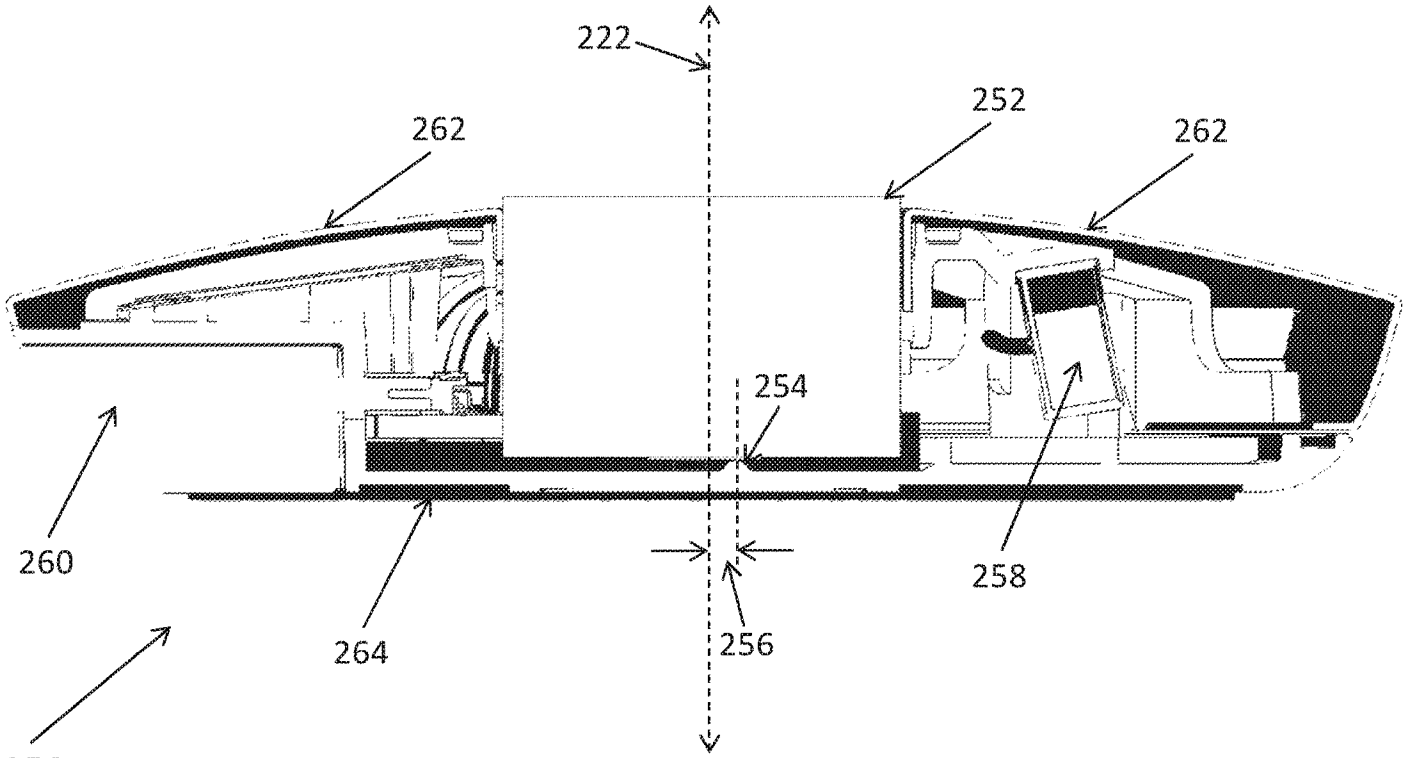
FIG. 2B illustrates an example stationary module.

FIG. 2B illustrates an example stationary module 250. In some embodiments, the stationary module (250) may be used as an outer module (e.g., 106 of FIG. 1A, etc.) of a device (e.g., 100 of FIG. 1A, etc.) that at least in part incorporates a light indicator (e.g., 102 of FIG. 1A, etc.) as described herein.

The stationary module (250) may be at least in part enclosed in a physical enclosure, a physical covering, etc. In some embodiments, the stationary module (250) has an outer surface 262 that is viewable to users in operations of the device incorporating the stationary module (250).

In some embodiments, the stationary module (250) has a base 264 with which the stationary module (250) may be affixed to, movably placed on, etc., a surface (e.g., on a table, on a stand, on a fixture, etc.) external to the device incorporating the stationary module (250). In some embodiments, the base (264) may not be viewable to users in operations of the device incorporating the stationary module (250).

In some embodiments, the stationary module (250) is of a shape, a contoure, etc., with which a spatial cavity 252 is formed. In some embodiments, a movable module (e.g., 200 of FIG. 2B, etc.), can be placed within the spatial cavity (252) formed by the shape, contour, etc., of the stationary module (250). To operate with the movable module, on a surface portion of the stationary module (250) opposing to a switch (e.g., a tactile switch, etc.), a protrusion 254 (e.g., a small metallic or non-metallic nib, etc.) may be provided/placed. The protrusion (254) may be located in any of a wide variety of positions that can be made in contact with the switch in the movable module when the movable module is pressed down along the vertical direction (222). In some embodiments, the protrusion (254) is located at an off-center position with a horizontal distance 256 to the vertical axis (222) that is non-zero.

Under the outer surface (262) of and inside the stationary module (202) are one or more of electric components, mechanical components, optical components, etc. In some embodiments in which the device incorporating the stationary module (250) is an external microphone device, the stationary module (250) may, but is not limited to, include a microphone element 258, etc. Additionally, optionally, or alternatively, the stationary module (250) may comprise an opening, a spatial portion (e.g., 260, etc.), etc., to route one or more cables (e.g., 108 of FIG. 1A, etc.), etc.

Figure 2C:
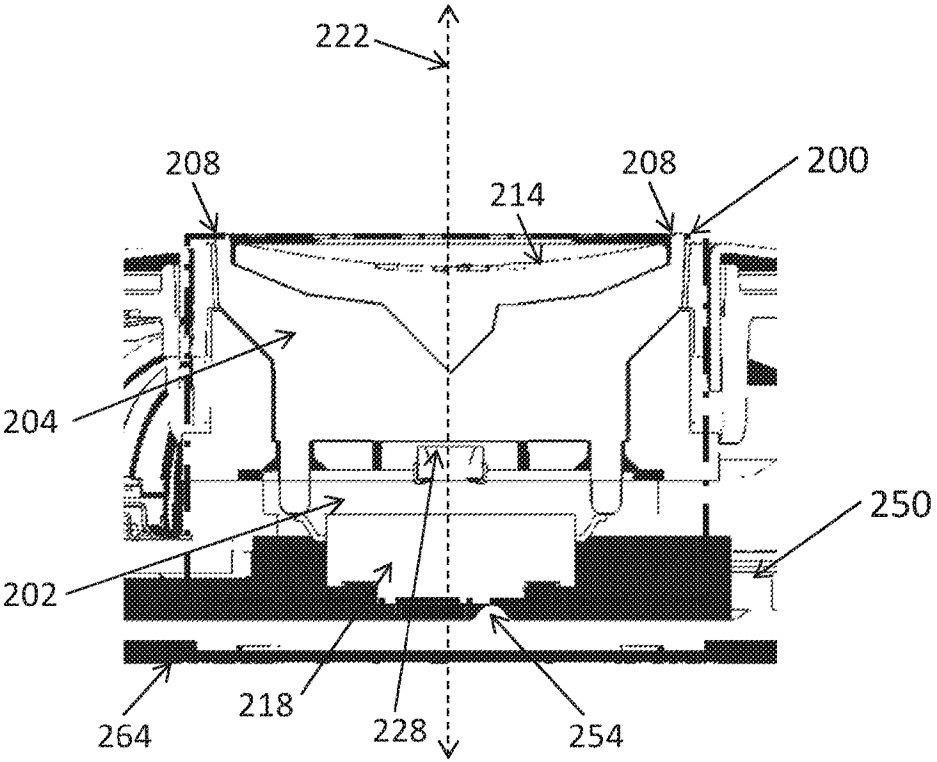
FIG. 2C illustrates a partial view of an example device.

FIG. 2C illustrates a partial view of an example device (e.g., 100 of FIG. 1A, etc.) that comprise a movable module (e.g., 200, etc.), a stationary module (e.g., 250, in partial view, etc.), etc. As discussed, the movable module (200) may be used in a wide variety of audio or other electronic devices. In some embodiments, the movable module (200) may be at least partly used as a high-end button switch. When a user exerts a physical force comprising a downward force component along the vertical axis (222) on the operational surface (214), the movable module (200) generates a spatial displacement relative to the stationary module (250) downward along the vertical axis (222) in response to the physical force exerted on the operational surface (214) that comprises the downward force component along the vertical direction (222). In various operational scenarios, the physical force exerted by the user may or may not comprise a horizontal force component that is perpendicular to the vertical direction (222), in addition to the force component along the vertical direction (222).

In some embodiments, some or all of the operational surface (214), the edge (208) of the light indicator (204), one or more light emitters 228, the switch (218), the second operational surface (220 of FIG. 2A) may be coaxial, sharing a common vertical axis such as the vertical axis (222). Additionally, optionally, or alternatively, some or all of the operational surface (214), the edge (208) of the light indicator (204), one or more light emitters 228, the switch (218), the second operational surface (220 of FIG. 2A) may be (e.g., perfectly, substantially such as within a small spatial tolerance that is 1 millimeters, 1+ millimeters, a fraction of millimeter, etc.) symmetric around the vertical axis (222). In various embodiments, one or more protrusions on the stationary module (250) may be located at the center (relative to the vertical axis 222) or off the center (off from the vertical axis 222). For the purpose of illustration, the protrusion (e.g., 254, etc.) is off the center (off from the vertical axis 222), for example, (e.g., 1 millimeter, 2 millimeters, 3+ millimeters, etc.) beyond the mentioned small spatial tolerance.

In some embodiments, as the movable module (200) is pressed downwards to the bottom of the device in the stationary module (250), the PCB (202) and the light indicator (204), which may be rigidly secured to the PCB (202), performs a (e.g., synchronous, identical, etc.) downward motion with a spatial displacement (e.g., a linear spatial displacement, etc.) in the downward vertical direction, which may coincide with the vertical axis (222). In some embodiments, the motions of the PCB (202) and the light indicator (204) made in response to a user pressing on the operational surface (214) of the movable module (200) are free (e.g., devoid, etc.) of relative motions between the PCB (202) and the light indicator (204). At the same time as the movable module (200) is pressed downwards to the bottom of the device in the stationary module (250) a switch (e.g., 218, etc.) in the movable module (200) performs a linear downward motion at least until a certain point at which the second operational surface (220) of the switch (250) is being depressed against (e.g., a protrusion on, etc.) the inside surface of the bottom of the device in the stationary module (250). In some embodiments, the depression of the switch (218), in response to the user pressing the movable module (200), is made off-axis or off-center by a (e.g., relatively small, etc.) protrusion 254 on inside surface of the bottom of the device in the stationary module (250). The off-axis or off-center depression causes a plunger (not shown) in the switch (218) to rotate (or rock) away from a vertical direction, or perform an angular motion that generates an angular displacement from the vertical axis (222). The amount of rotation, or the angular displacement, of the plunger in the switch (218) can be controlled at least partly with one or more of the mentioned spatial displacement of the PCB (202), a height of the protrusion (254), a distance of the protrusion (254) to the vertical axis (222), the type of the switch (218), etc.

In some embodiments, depressing the switch (218) with an off-axis protrusion (e.g., 254 as shown in FIG. 2C, etc.) provides a tactile feedback (e.g., a gentle tactile feedback, a relatively smooth tactile feedback, etc.), as received by the user through the movable module (200), that is different from another tactile feedback (e.g., a relatively harsh tactile feedback, a relatively resisting tactile feedback, etc.) that would be produced with an on-axis protrusion. In the meantime, depressing the switch (218) with the off-axis protrusion provides an audible feedback of acoustic characteristics (e.g., relatively low sound frequencies, an audible feedback similar to what produced by closing a car door on a luxury car, a relatively smooth sound, etc.), as heard by the user, that are different from acoustic characters (e.g., relatively high sound frequencies, an audible feedback similar to what produced by closing a car door on a low-end car, a high-pitch clicking sound, a noise resembling tin can dropping, etc.) of an audible feedback that would be produced with an on-axis protrusion.

In some embodiments, the movable module (200) may comprise one or more relatively weighty components. For example, a part such as a first assembly part (e.g., 210 of FIG. 2A, etc.), a second assembly part (e.g., 212 of FIG. 2A, etc.), etc., may be made of a relatively weighty material such as a metal, a dense composite material, etc. Additionally, optionally, or alternatively, a mass may be affixed to a part such as a PCB (e.g., 202, etc.), a first assembly part (e.g., 210 of FIG. 2A, etc.), a second assembly part (e.g., 212 of FIG. 2A, etc.) the PCB 2, to give the movable module (200) a "weightier" feel when depressed than otherwise. An increase in mass of the movable module (200) may provide the user an impression of higher quality than otherwise. Additionally, optionally, or alternatively, the increase in mass may cause the movable module to dampen high frequency sound and produce an audible feedback with relatively lower frequency content when the user presses on the movable module (200).

5. Light Indicator

Figure 3:
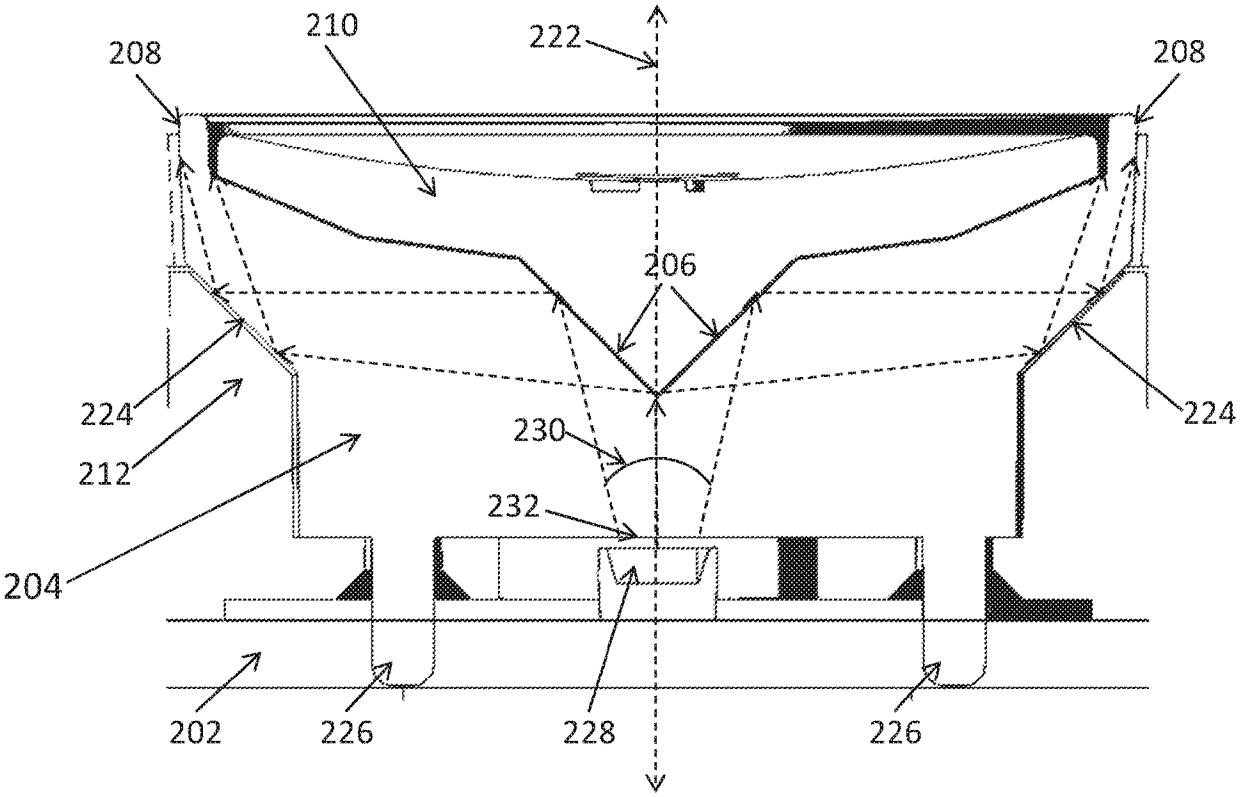
FIG. 3 illustrates an example light indicator.

FIG. 3 illustrates an example light indicator (e.g., 204, etc.). The light indicator (204) may be mounted on, or otherwise secured to, a PCB (e.g., 202, etc.) through a base portion 226 of the light indicator (204). A light receiving surface portion 232 (e.g., on a lower surface as shown, etc.) of the light indicator (204) may be configured to receive light transmitted from one or more light emitters 228 (e.g., mounted on the PCB 202, etc.) when a device (e.g., 100 of FIG. 1A, etc.) that incorporates the light indicator (204) is in one or more operational states. In some embodiments, the light receiving surface portion (232) may be perpendicular to (e.g., exactly or within a small tolerance measured by a few degrees, 3 degrees, 5 degrees, a fraction of degree, etc.) a vertical axis such as 222 of FIG. 2A. In other words, the vertical axis (222) may be a normal direction (e.g., exactly, within the small tolerance, etc.) of a plane that is coplanar with the light receiving surface portion (232).

The light transmitted by the light emitters (228) may comprise any of monochrome light, color light, multi-color light, etc. In some embodiments, the light emitters (228) can be controlled, for example by a processing logic implemented at least in part in hardware, to emit any of a plurality of different light colors. In a non-limiting implementation, the light emitter directs its light upward into a cavity until reaching the light receiving surface portion (232); most of the energy or intensity of the light as received through the light receiving surface portion (232) by the light indicator (204) from the light emitters (228) may be substantially (e.g., over a threshold amount such as 50+%, 60%, 70%, 80%, 90%, 90+%, etc.) concentrated directionally in a solid angle 230. The light in the solid angle (230) may reach one or more first internal light reflective surfaces (e.g., 206, etc.), and may be internally reflected by the first light internal reflective surfaces (206) toward one or more second internal light reflective surfaces (e.g., 224, etc.). The second internal light reflective surfaces (224) may be configured to direct a relatively large portion of the light incident from the first internal light reflective surfaces (224) towards a spatial portion of the light indicator (204) so as to cause an edge (e.g., 208, etc.) of the light indicator (204) to be illuminated by the light originated from the light emitters (228) when the device (e.g., 100 of FIG. 1A, etc.) that incorporates the light indicator (204) is in the one or more operational states.

In some embodiments, the light indicator (204) comprises, or is formed by, a light transmissive medium such as a transparent material, etc. The light transmissive medium in the light indicator may be of a shape (e.g., a shape resembling a dish to a certain extent, a hemispheric shape, etc.) that implements built-in folded optics configured to fold or bend light rays from the light emitters (228) to the edge (208) into multiple segments.

The shape of the light transmission medium in the light indicator (204) may be implemented with any of a variety of aspect ratios or sizes. In some embodiments, the shape of the light transmission medium in the light indicator (204) may be selected from a plurality of possible designs, shapes, etc., based on one or more selection criteria. These selection criteria may include, but are not limited to only, any of: overall ergonomic factors of the device (100), an amount of light diffusion to be achieved on the edge (208), an amount of light intensity to be achieved on the edge (208), a size of the solid angle (230), a vertical height of the light indicator along the vertical axis (222), a horizontal width of the light indicator in a plane perpendicular (or normal) to the vertical axis (222), a size of the PCB (202), a size of the light emitters (228), a size (e.g., of the second operational surface 220, etc.) of the switch (218), etc.

In some embodiments, shapes of the components in the device (100) may be selected and designed to produce an overall shape of the device (100) with a relatively low vertical profile. In some embodiments, the overall shape of the device (100) may also be selected and designed to be similar to another device such as a conference phone device, etc., with which the device (100) may operate in conjunction. The built-in folded optics implemented by the light indicator (204) helps reduce the vertical profile (or physical dimension) of the device (100), and at the same time increases lengths of optical path from the light emitters (228) to the edge (208) for light spreading/dispersion purposes.

In some embodiments, exterior surfaces of the light indicator (204) are coated, or otherwise disposed, with an optical material such as an optical film, a coating, etc. In some embodiments, Snell's law may be used to determine an overall design or selection of optical parameters, geometric shapes, etc., of the light indicator (204) such that the light in a light cone as represented by the solid angle (230) is totally or substantially (e.g., 70%, 80%, 90+%, etc.) reflected from some or all of the first internal light reflective surfaces (206) or the second internal light reflective surfaces (224).

In an example in which the exterior surfaces of the light indicator are coated with an optical material, refractive indexes of the optical material and the light transmissive medium in the light indicator (204), first incident angles on the first internal light reflective surfaces (206), second incident angles on the second internal light reflective surfaces (224), etc., may be computed or constrained based on Snell's law so that total light reflection on some or all of the first internal light reflective surfaces (206), or the second internal light reflective surfaces (224) is produced for the light coming into the light indicator (204) in the solid angle (230) for the purpose of directing the light to illuminate the edge (208).

In another example in which the light indicator is not coated with an optical material and is separate by air gaps from a first assembly part (e.g., 210, etc.) and/or a second assembly part (e.g., 212, etc.), refractive indexes of the air and the light transmissive medium in the light indicator (204), first incident angles on the first internal light reflective surfaces (206), second incident angles on the second internal light reflective surfaces (224), etc., may be computed or constrained based on Snell's law so that total light reflection on some or all of the first internal light reflective surfaces (206), or the second internal light reflective surfaces (224) is produced for the light coming into the light indicator (204) in the solid angle (230) for the purpose of directing the light to illuminate the edge (208).

In a further example in which the light indicator is neither coated with an optical material nor separate by air gaps from a first assembly part (e.g., 210, etc.) and/or a second assembly part (e.g., 212, etc.), surfaces of the first assembly part (210) and/or the second assembly part (212) may be configured to be reflective (e.g., metal with light reflective surfaces, non-metal with light reflective surfaces, etc.) so that relatively high light reflection on some or all of the first internal light reflective surfaces (206), or the second internal light reflective surfaces (224) is produced for the light coming into the light indicator (204) in the solid angle (230) for the purpose of directing the light to illuminate the edge (208).

In some embodiments, the first internal light reflective surfaces (206) may form a cone shape in three-dimensional space. In some embodiments, the cone shape may be formed by straight lines radially projected from the vertex (or apex) of the cone. In some embodiments, the cone shape may be formed by straight line segments (e.g., relative to the vertical axis 222 with an incline such as 40 degrees, 45 degrees, 50 degrees, etc.), concave curve segments, convex curve segments, other curve segments, etc., radially projected from the vertex (or apex) of the cone. Likewise, the second internal light reflective surfaces (224) may also be formed by straight line segments (e.g., relative to the vertical axis 222 with an incline such as 40 degrees, 45 degrees, 50 degrees, etc.), concave curve segments, convex curve segments, other curve segments, etc. In various embodiments, one or more from a variety of geometries may be selected for the light indicator (204), or light reflective surfaces (e.g., 206, 208, etc.) therein, in order to generate light focusing and/or light diversing effects for the purpose of directing light to illuminate the edge (208) of the light indicator (204).

6. Diversity in Microphones

Figure 4:
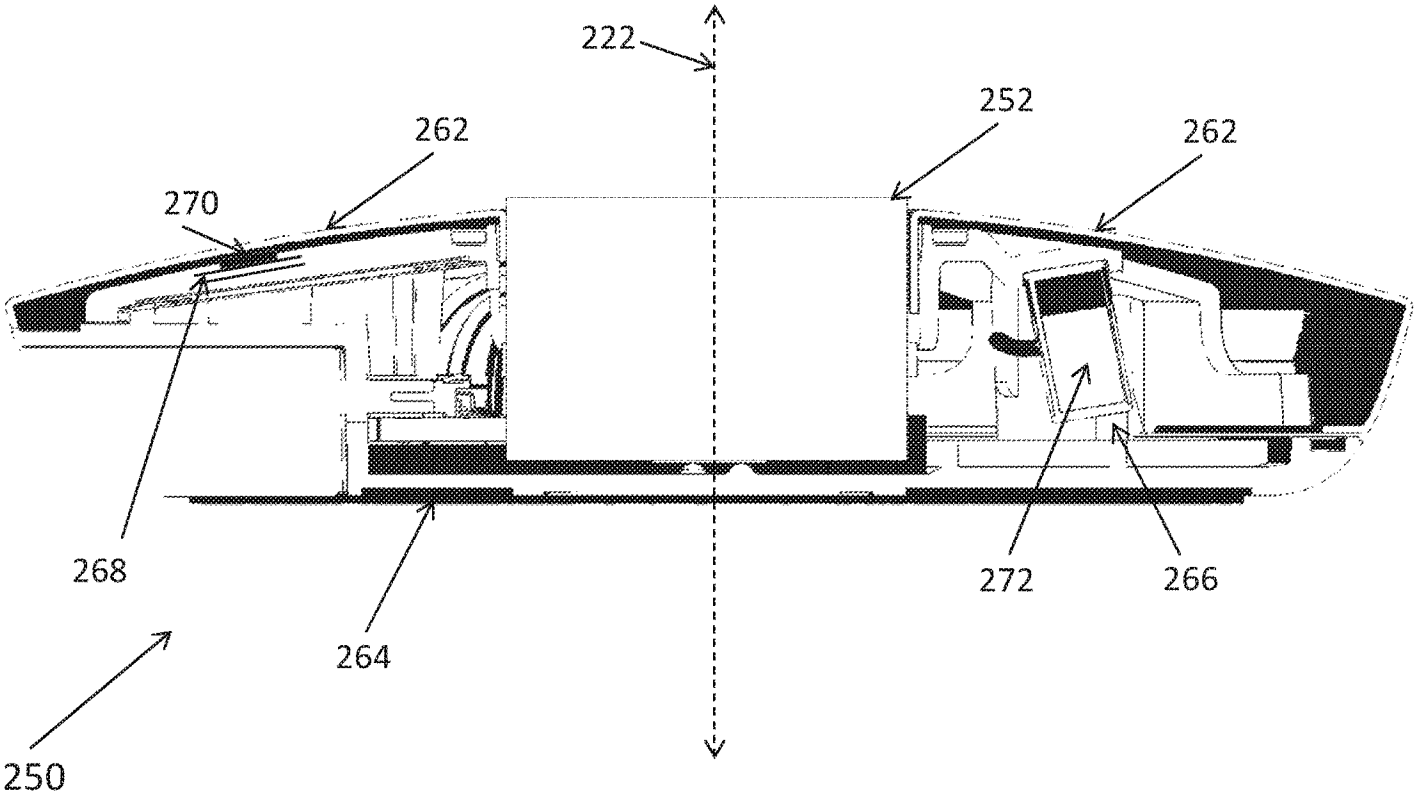
FIG. 4 illustrates an example configuration of a stationary module.
Figure 5:
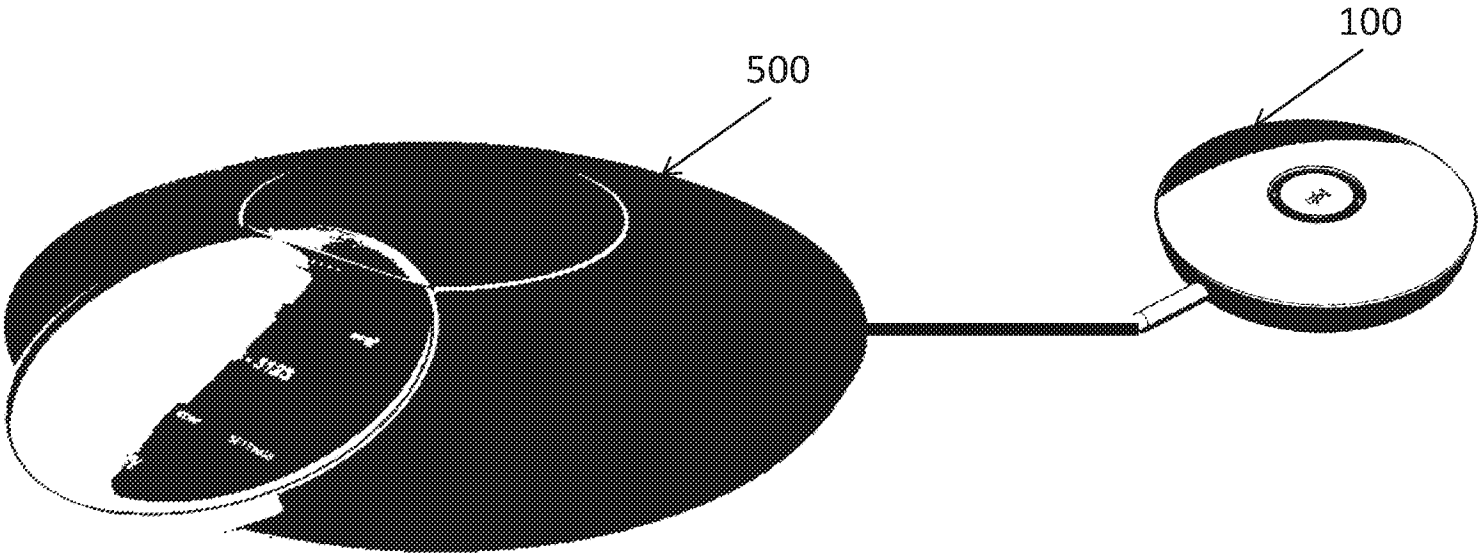
FIG. 5 illustrates an example configuration of an external microphone device and a conference phone device.

FIG. 4 illustrates an example configuration of a stationary module (e.g., 250, etc.) to support applications based at least in part on diversity in microphones. For the purpose of illustration only, an external microphone device (e.g., 100 of FIG. 1A, etc.) that incorporates the stationary module (250) acts as a satellite microphone to, and is connected and operated with, a conference phone device 500 as illustrated in FIG. 5.

The conference phone device (500) is a telephonic device that allows a group of people on one end (the "near" end) to participate in a conversation/conference with one or more people at one or more other ends (the "far" ends). The conference phone device (500) may include microphone elements in addition to microphone elements in the device (100) that includes the stationary module (250).

The microphone elements in the device (100) and/or the conference phone device (500) are configured to capture and convert some or all of acoustic sounds originated at the near end for transmission to the far ends of the conversation/conference. In some embodiments, the conference phone device may include and/or may operate with speaker elements to render audio signals received from the far ends into spatial pressure waves at the near end that represent sounds originated at the far ends.

In the example configuration of FIG. 4, the microphone elements in the stationary module (250) may be of two or more different microphone types. Example microphone types may include, but are not limited to only, any of: electret microphones, condensor microphones, crystal microphones, piezoelectric transducers, electromagnetic microphones, buzzers similar to those used in computers as dedicated ringers, microphones comprising crystals or ceramic parts exhibiting piezoelectric properties, ribbon microphones, etc.

In an example implementation, the stationary module (250) comprises a first microphone element 272 that is (e.g., resiliently, etc.) secured to a first support 266 on (e.g., a scaffold of, etc.) the stationary module (250) and a second microphone element 268 that is (e.g., rigidly, etc.) secured to a second support 270 on (e.g., a scaffold of, etc.) the stationary module (250).

The use of different types of microphone elements in a device, module, system, etc., provides diversity in microphones that can be used in a variety of audio related applications, phone related applications, etc. For example, in the conversation/conference enabled in part through the conference phone device (500) and the device (100), a variety of sounds may be originated at one or more of the near end or the far ends. A user may touch a surface of a table on which the device (100) sits or other mechanical actions with other objects. Additionally, optionally, alternatively, the user may touch on, create frictional contacts with, rest fingers on, tap on, etc., operational surface portions, non-operational surface portions, etc., of the device (100) before activating or engaging a button (e.g., through an inner module 214 of FIG. 1A, etc.). As the user performs these mechanical actions (e.g., manual actions, physical actions, etc.) purposely, inadvertently, transiently, etc., "mechanical" noises may be generated and propagaged through the structure of the device (100) and mechanical components therein. These mechanical noises may or may not generate sufficiently strong spatial pressure waves in air to make these noises audible to users who are present around the device (100).

In some embodiments, one or more first microphone elements of a first type in a device may be configured/optimized to be relatively more responsive to acoustic sounds than to mechanical noises, whereas one or more second different microphone elements of a second different type in the device may be configured/optimized to be relatively less responsive to acoustic sounds than to mechanical noises. For example, the first microphone element (272) in the stationary module (250) of FIG. 4 may be an electret microphone configured/optimized to pick up or capture acoustic sounds represented by spatial pressure waves in air, whereas the second microphone element (268) in the stationary module (250) of FIG. 4 may be a piezoelectric diaphragm microphone configured/optimized to pick up or capture mechanical noises, to a relatively large extent, propagated inside mechanical parts of the device (100) that incorporates the stationary module (250).

Techniques as described herein may be used to increase diversity in microphones. For example, a microphone such as the first microphone element (272), etc., that is configured to pick up or capture acoustic sounds, the microphone may be built or secured with a resilient support and/or zero, one or more additional dampers to attenuate mechanical noises that may be mixed with acoustic sounds and/or may be transmitted in the structure, chassis, housing, cover, etc., of the device (100).

On the other hand, a microphone such as the second microphone element (268), etc., that is configured to pick up or capture mechanical noises, the microphone may be rigidly, solidly, etc., built or secured with the structure, chassis, housing, cover, etc., of the device (100) to enhance reception of mechanical noises that may be propagated in the structure, chassis, housing, cover, etc., of the device (100). Additionally, optionally, or alternatively, the microphone may be built (e.g., in a cavity of metallic or non-metallic material, etc.) inside of a solid material in the device (100) to shield (or isolate) the microphone from acoustic paths traversed by spatial pressure waves in air.

Instead of, or in addition to, using classifiers based on complicated sound recognition algorithms, diversity in microphones as provided by two or more different types of microphone elements may be exploited for distinguishing or discriminating different types of noises in an environment relatively easily and efficiently. Information that may not otherwise be apparent with a single type of microphone can be (e.g., readily, apparently, etc.) extracted from differential responses by different types of microphones. A digital signal processor (DSP) may be used to analyze the difference in two or more sound acquisition signals generated by different types of microphones.

In the present example, the first microphone element (272) may generate a first response to acoustic sounds such as voices generated by conference participants, and a second response to mechanical noises such as generated by a user's mechanical actions. The first response generated by the first microphone element (272) to the acoustic sounds may be relatively large as compared with the second response generated by the first microphone element (272) to the mechanical noises, as the first microphone element (272) such as an electret microphone, etc., is configured/optimized for spatial pressure waves in the air.

The second microphone element (268) may generate a third response to the acoustic sounds, and a fourth response to the user's mechanical actions. The fourth response generated by the second microphone element (268) to the mechanical noises may be relatively large as compared with the third response generated by the second microphone element (268) to the acoustic sounds, as the second microphone element (268) such as a piezoelectric diaphragm microphone, etc., is configured/optimized for mechanical noises propagated in the structure of the device (100). Differential responses of microphone elements as described herein may be communicated to (e.g., via one or more cables 108 of FIG. 1A, internal data connections in a device, etc.) and analyzed by a processing unit, a controller unit, etc., that may be implemented at least partly in hardware in the device (100), the conference phone device (500), a console unit operating in conjunction with a conference phone system, etc.

The differential responses of the second microphone element (268) may be correlated with the differential responses of the first microphone element (272) to detect, distinguish or discriminate between the acoustic sounds and the mechanical noises that, for example occur in the near end.

In first example operational scenarios, in response to determining that the device (100) is picking up or capturing acoustic sounds, the device (100) may transmit the acoustic sounds to the far ends, when the near end is not muted. In some embodiments, the acoustic sounds that are transmitted from the near end to the far end comprise little or no acoustic sounds that were originated from the far ends but are rendered by speaker elements at the near end, for example, based on one or more of a wide variety of techniques for echo cancellation. In response to determining that the device (100) is picking up or capturing mechanical noises, the device (100) may prevent the mechanical noises from being transmitted to the far ends.

When acoustic sounds originated from the far ends are rendered by speaker elements at the near end, the rendered far end acoustic sounds at the near end may be directly captured by microphone elements active at the near end. Additionally, optionally, or alternatively, reflected acoustic sounds from the rendered far end acoustic sounds may be captured by the microphone elements. The rendered far end acoustic sounds at the near end may be reflected in many different echo paths with different time delays, depending on locations of the speaker elements, the locations of the microphone elements, the geometry of the near end, etc.

A conference phone device such as 500 of FIG. 5 may implement echo cancellation algorithms that are performed from time to time with relatively large time constant to avoid constant threshing and instability. For example, the conference phone device (500) may be configured to activate and perform an echo cancellation algorithm at the beginning of the conversation/conference.

In second example operational scenarios, one or both of the conference phone device (500) or the device (100) individually or in combination may be configured to analyze and correlated differential responses of different types of microphone elements, to detect changes in acoustic sounds and/or mechanical noises, to determine whether an external microphone device has been moved based on the detected changes, etc. In response to determining (e.g., above a certain confidence threshold such as 80%, 90%, etc.) that the external microphone device has been moved, the conference phone device (500) may be configured to trigger, activate, perform, etc., an echo cancellation algorithm as echo paths at the near end have been changed because of the detected movements of external microphone devices.

In some embodiments, different conference participants at different geographic locations may be represented with different spatial locations in a sound field image rendered at the near end. The different spatial locations in the sound field image may be real or artificial. For example, voices from a first conference participant joined from a first city may be rendered as coming from a first location in the sound field image, whereas voices from a second conference participant joined from a second different city may be rendered as coming from a second different location in the same sound field image, even though the actual geographic locations of the first and second conference participants may be miles apart. The rendering of voices from different conference participants as coming from different locations in the sound field image provides or injects spatial cues, angular cues, etc., to the voices so that a conference participant at the near end can better determine an identity of an active speaker and better comprehend voice content from any given conference participant who is making utterance in the conversation/conference.

In third example operational scenarios, one or both of the conference phone device (500) or the device (100) individually or in combination may be configured to analyze and correlated differential responses of different types of microphone elements, to detect changes in acoustic sounds and/or mechanical noises, to determine whether an external microphone device has been moved based on the detected changes, etc. In response to determining (e.g., above a certain confidence threshold such as 80%, 90%, etc.) that the external microphone device has been moved, the conference phone device (500) may be configured to trigger an algorithm that determines or re-determines locations in the sound field image for different conference participants.

For the purpose of illustration only, removal of mechanical noises, echo cancellation, etc., have been described as operations that may be performed at the near end. However, it should be noted that techniques as described herein are not limited to only be performed at the near end. For example, in various embodiments, these techniques can also be implemented and/or performed in any of the one or more far ends.

In some embodiments, diversity in microphones can be exploited to determine whether a user has deliberately tapped a microphone device for the purpose of triggering an operation such as recording the conversation, etc. In other words, "special" mechanical noises that are caused by deliberate mechanical actions of a user may be used as cues, user input, user interface interactions, etc., to trigger operations.

In some embodiments, a user such as a chairperson of the conversation/conference may be provided with information based on noises, acoustic sounds, etc., as detected from differential responses of different types of microphones. The information may identify a particular microphone device or a particular user at such a microphone device that is making or experiencing noises (e.g., table scratching noises, wind noises in a moving car, etc.) that interfere with the conversation/conference. The chairperson may even be given controls or options, for example with a control console at the conference phone device, to bring the particular user's attention to the noises that are being generated by the microphone device the particular user is using, to eject the particular user from the conversation/conference (e.g., in rare occasions, etc.), to remotely mute the microphone device, etc.

Although a circular design is depicted for an elongated edge of a light indicator, an inner module, an outer module, etc., and may be advantageous in certain devices, other shapes may also be used for an edge of a light indicator, an inner module, an outer module, etc. In other embodiments, multi-sided shapes including, without limitation, triangles and rectangles may be used. The term "ring" or "light ring" does not imply a circular shape in the edge of the light indicator, but may be any shape that substantially surrounds an inner module as described herein. The corners of a multi-sided shape of the edge of the light indicator may be rounded to prevent light clusters from appearing and to allow for a more uniform glow. For example, the (e.g., visible, terminal, etc.) edge of the light indicator (e.g., 102, etc.) may form a triangular ring with rounded corners around the inner module (e.g., 104, etc.) rather than the circular ring.

In some embodiments, the edge of the light indicator (102) may be proud of the outer surface of the device (100). For example, the edge may protrude by approximately 0.5 to 1 millimeter above the nearest outer surface of the inner module (104) and/or the outer module (106). This approach may be used to create a "halo" effect as the lighted ring appears above the outer surface of the device (100). A slight protrusion may also allow for better visibility from the side of the device without significantly reducing the contrast of the indicator light. In an alternative embodiment, the edge of the light indicator (102) may be placed below the surface of the device. This approach would restrict the viewing angle of the light ring; however, this may be useful, for example, as an indicator visible to an operator of the device (102) that is near the device (102). In another embodiment, the edge of the light indicator (102) may be flush with the outer surface of the device (100). This approach allows the outer surface of the device (100) to be smooth without significantly restricting the visibility of the light.

The circular edge of the light indicator (102) as depicted in figures has a smooth flat surface. However, in other embodiments texture could be added to the edge of the light indicator (102) to create different visual effects. For example, when viewing from an overhead view, the circular edge of the light indicator (102) could have a triangular, sawtooth, or rectangular pattern instead of a smooth flat surface.

An advantage of the physical configurations described herein is that relatively few light emitters may be used to give good illumination uniformity. Besides being less costly, having fewer emitters means consuming less energy, making the resulting configuration energy efficient. The emitters can be made from LEDs, and can be monochrome or multi-colored. The LEDs may have a conical radiation pattern. The light indicator (102) may mix the light from the emitters to generate an even luminosity around the edge of the light indicator (102). The mixing of light may also be used to control illumination color on the edge of the light indicator (102). The light emitters may include LEDs that can emit red, green, and/or blue light. The device (102) may generate any hue by modulating the brightness of each of the three colors according to a color model such as an RGB color model, etc. In some embodiments, modulated red, green, and blue light mix within the core of the light indicator (102) before reaching and illuminating the edge of the light indicator (102).

In some embodiments, the edge of the light indicator (102) may be segmented, rather than continuous. For example, instead of a continuous uniform-width circular ring, the edge of the light indicator (102) may be split into segments to create a broken circle design. In between each segment, there may be a non-illuminated gap or a gap of opaque material. This approach may also be applied to multi-sided shapes to create a broken triangle, rectangle, or other design. The number and length of the segments may vary from implementation to implementation. Each segment of the edge of the light indicator (102) may be controlled by a different light emitter or set of light emitters. For example, each segment may include a red, green, and blue light emitter. The light within each segment is mixed, but may remain separate from other segments; for example, each segment of the edge of the light indicator (102) may have its own core. Each segment of the edge of the light indicator (102) could thus be illuminated at a different brightness and/or with a different color.

In the physical configuration depicted, light emitters are obscured by the housing of the inner module. In an alternative configuration, light emitters may be visible through a mesh or grating surface on the device (102). For example, the housing of inner module 104 may allow light to pass through such surfaces instead of being opaque. This would create a wheel type of effect for a circular light ring shape. The light ring as represented by the edge of the light indicator (102) would be the rim and the light emitters the hub.

Techniques as described herein can be applied to external microphone device, as well as other devices that include, without limitation, portable devices, mobile devices, phone devices, audio players, accessory microphones, headphones, media playback devices, electronic devices, etc.

For example, an illuminated or non-illuminated edge of a light indicator (e.g., 102, etc.) on a device may be used as an indicator to convey various types of information to users of the device or users of a system that includes the device. The information and the manner in which the information is conveyed may vary from implementation to implementation based on the nature of the device. In a phone-related device, for example, the light indicator may be used to indicate the status of a call. Using a control panel on a conference phone device, a user may, by pressing a physical button or an icon on a touchscreen display, select to mute a satellite microphone, to mute the conference phone device as well as subtending microphones, etc. Muting a satellite microphone or a conference phone device prevents the listener on the far end of the phone call from hearing sounds that may otherwise be captured by the satellite microphone or the conference phone device. In response to muting the call, light emitters may be activated to generate (or changed to emit)

a certain color light (e.g., monochrome light, red light, green light, blue light, etc.), propagating light through the light indicator (102) and causing the edge of the light indicator (102) to become illuminated with the certain color light. The illuminated edge may be viewed from a large range of azimuths and angles. Thus, some or all participants in a conference call may easily determine when the call is muted. When the call is unmuted (e.g., the mute button is pressed again), the light emitters may be deactivated (or changed to emit a different color light) causing the illumination of the edge with the certain color light to cease. In a similar manner, the edge of the light indicator (102) may be illuminated differently or turned off in response to other input to convey other information. In a telephonic device, such an edge may be illuminated when a call is placed on hold, a call is connected, and/or a call is incoming. In a media playback device, the edge may be illuminated when music or other media playback is initiated.

Different colored or multi-color light emitters can be used to provide the light source and convey different, color-coded information to the user. In a telephonic device, the light ring may be illuminated one color (e.g., red, etc.) when the call is muted, another color (e.g., green, etc.) when on call and unmuted, and a third color (e.g., blue, etc.) when an incoming or outgoing call supports three-dimensional audio effects. Other colors may be used to indicate information such as the operational status of a device, the type of call to which a telephonic device is connected, the quality of the audio, etc.

Light emitters may be centered or distributed evenly around the base of the light indicator (102) to ensure an even illumination of the edge of the light indicator (102). However, in some embodiments, the light emitters could be deliberately controlled to provide regions of higher or lower intensity across the edge of the light indicator (102). The intensity could indicate the level of the sound being received into the device, or picked up by microphones on the device. The illumination on the edge of the light indicator (102) may become brighter as the sound picked up by the microphones becomes louder and dimmer as the sound becomes quieter. Similarly, the intensity could indicate the intensity level for capturing sound from one or more conference participants. The light intensity could be varied over time to provide the effect of ring pulsing in brightness. For example, the illumination on the edge of the light indicator (102) may pulsate with changes in the intensity level for capturing sound.

Other lighting effects may also be applied to the edge of the light indicator (102) to convey light-effect coded information. For example, each individual light emitter can be controlled to be illuminated in sequence to give the perception of a moving light source across different sections of the edge. When the edge forms a circular ring around the inner module, this gives the effect of a light moving in a circle. For a segmented edge, each segment of the edge of the light indicator (102) may be illuminated in a different sequence and/or with different colors. In addition or alternatively, different segments of the edge may be used to convey different or the same information to different areas of a device. Such lighting effects may be used to convey, without limitation, any of the information described above such as the status of a call or other operation of a device, the quality of the audio being captured or broadcast, the intensity/volume of the audio being captured or broadcast, any other type of information responsive to input received by the device, etc.

7. Example Embodiments

An apparatus (e.g., device 100 of FIG. 1A through FIG. 1B, FIG. 5, etc.) comprising: a stationary module (e.g., outer module 106 of FIG. 1A, 250 of FIG. 2B, FIG. 2C, FIG. 4, etc.); a movable module (e.g., inner module 104 of FIG. 1A, 200 of FIG. 2A, FIG. 2C, etc.) having an outer surface (e.g., operational surface 214 of FIG. 2A, FIG. 2C, etc.) and a substrate (e.g., PCB 202 of FIG. 2A, FIG. 2C, etc.); a tactile switch (e.g., 218 of FIG. 2A, FIG. 2C, etc.) secured on a first side (e.g., upward facing side, etc.) of the substrate; a light indicator (e.g., 204 of FIG. 2A, FIG. 2C, etc.) secured on a second side (e.g., downward facing side, etc.) of the substrate, the first side and the second side being opposing sides of the substrate; the movable module being configured to generate a spatial displacement relative to the stationary module along a spatial direction (e.g., a downward direction along vertical axis 222 of FIG. 2A, FIG. 2B, FIG. 2C, etc.) in response to a physical force exerted on the outer surface along the spatial direction. In an embodiment, the apparatus a portable device.

In an embodiment, the light indicator may represent a light guide, a light pipe, etc. In an embodiment, the light indicator comprises, or is formed with, a (e.g., homogeneous, amorphous, transparent, translucent, etc.) light transmission medium with a flat light receiving surface portion perpendicular to a central axis (e.g., an axis of symmetry, a vertical axis such as 222 of FIG. 2A through FIG. 2C, FIG. 3, FIG. 4, etc.) of the movable module. In an embodiment, the light indicator has a depression (e.g., formed by first internal light reflective surfaces 206 of FIG. 3, etc.) below the operating surface designed to provide a light reflective surface that reflects/directs light to an edge (e.g., 208 of FIG. 2A, FIG. 2C, FIG. 3, etc.) of the light indicator.

In an embodiment, the substrate is stationary relative to the light indicator and moves with the movable module (e.g., synchronously, identically, etc.) as the light indicator.

In an embodiment, the outer surface of the movable module is upward facing, whereas the tactile switch is downward facing.

In an embodiment, the physical force is exerted by a user; the substrate is attached with a mass that provides a gravitational force in addition to the physical force.

In an embodiment, the substrate is a printed circuit board (PCB) on which at least one of the tactile switch or the light indicator is mounted. In an embodiment, the light indicator is configured to illuminate an edge of the light indicator from light generated by one or more active light emitters mounted on the PCB.

In an embodiment, a normal direction of the outer surface at a central point of the outer surface coincides with a normal direction (e.g., vertical axis 222, etc.) of the substrate.

In an embodiment, the tactile switch is configured to generate a switch state change in response to the physical force. In an embodiment, the light indicator is configured to generate a light indicator state change perceivable through an edge of the light indicator in response to the switch state change.

In an embodiment, the tactile switch is located in an interior region of the movable module with no surface of the tactile switch exposed to (e.g., direct manipulations by, direct view of, etc.) a user of the apparatus.

In an embodiment, an elongated edge of the light indicator is configured to be illuminated in one or more light indicator states and is located along a perimeter of the movable module.

In an embodiment, at least a portion of the light indicator is a part of the movable module.

In an embodiment, the stationary module is an outer module that substantially surrounds a perimeter of the movable module. In an embodiment, the outer module includes one or more microphones for capturing sound. In an embodiment, the microphones are arranged in an array in the outer module. In an embodiment, the microphones are secured to different types of physical support.

In an embodiment, the microphones are of a single type. In an embodiment, the microphones are of two or more different types. In an embodiment, one or more first signals picked up by one or more first microphones of a first type of the two or more different types are used to reduce noises in at least one of one or more second signals picked up by one or more second microphones of a second different type of the two or more different types are optimized for picking up mechanical vibrations.

In an embodiment, one or more first microphones of a first type of the two or more different types are optimized for picking up acoustic signals, whereas one or more second microphones of a second different type of the two or more different types are optimized for picking up mechanical vibrations.

In an embodiment, a first type of the two or more different types comprises one or more electret microphones; a second different type of the two or more different types comprises one or more piezoelectric transducers.

In an embodiment, the microphones switch between an on state and an off state (or between an unmuted state and a muted state) in response to the switch state change.

In an embodiment, an edge of the light indicator is configured to be illuminated in a first light indicator state when the microphones are in the on state, whereas the edge of the light indicator is configured to be illuminated in a second different light indicator state when the microphones are in the off state.

In an embodiment, an edge of the light indicator is configured to be not illuminated in a light indicator state when the microphones are in one of the on state or the off state.

In an embodiment, the apparatus comprises a plurality of light emitters. The light indicator comprises a light distribution medium that transports light projected from at least some of the plurality of light emitters to an edge of the light indicator.

In an embodiment, the light indicator enters into a light indicator state as a result of the light indicator state change, and maintains the light indicator state after the physical force ends until a new physical force is exerted on the outer surface of the movable module.

In an embodiment, the light indicator comprises a light distribution medium configured to diffuse and recirculate light from light sources before at least a portion of the light emitted from an edge of the light indicator.

In an embodiment, the light indicator comprises a light distribution medium that is curved and transports light from light emitters along a curved path to an edge of the light indicator.

In an embodiment, the light indicator comprises a contiguous (e.g., homogeneous, etc.) interior volume substantially surrounded by one or more light reflective surfaces.

In an embodiment, at least one of one or more light reflective surfaces in the light indicator comprises one of a metallic surface or a non-metallic surface.

In an embodiment, the light indicator is dish-shaped. In an embodiment, the light indicator is tube-shaped.

In an embodiment, the tactile switch is a part of the movable module.

In an embodiment, the apparatus represents a satellite microphone device. In an embodiment, the satellite microphone device operates in conjunction with one or more other devices of a phone system; at least one of the other devices comprises one or more microphones configured to switch between an on state and an off state in response to a switch state change caused by the physical force.

In an embodiment, a central axis of the movable module and a central axis of the edge of the light indicator are coincident.

In an embodiment, an edge of the light indicator is circular, triangular, rectangular, polygonal, curved, elliptic, or irregular in shape.

In an embodiment, an elongated edge, configured to be illuminated in one or more light indicator states, of the light indicator comprises a plurality of distinct visual segments. In an embodiment, an elongated edge, configured to be illuminated in one or more light indicator states, of the light indicator is uniform in width across length of the edge. In an embodiment, an edge of the light indicator is proud of a surface that includes the outer surface of the movable module.

In an embodiment, the light indicator is configured to mix together light from a plurality of light emitters within the light indicator before reaching an edge of the light indicator. In an embodiment, the plurality of light emitters include at least one of red light emitting diodes (LEDs), green LEDs, or blue LEDs.

In an embodiment, the apparatus further comprises a controller, implemented at least in part in hardware, that causes an edge of the light indicator to be illuminated in response to a request to mute a call.

In an embodiment, the apparatus further comprises a controller, implemented at least in part in hardware, that causes an edge of the light indicator to be illuminated with a first color in response to determining a first status associated with a call and a second different color in response to determining a second different status associated with the call.

In an embodiment, the apparatus further comprises a controller, implemented at least in part in hardware, that causes an intensity with which an edge of the light indicator is illuminated to change based on an intensity at which sound is being captured or broadcast.

In an embodiment, the light indicator comprises a light transmission medium having one or more of air, vacuum, optical media transparent to at least one wavelength range of visible light, or optical media diffusive to at least one wavelength range of visible light.

In an embodiment, the light indicator is configured to illuminate an edge of the light indicator with light from at least one of: light-emitting diodes (LEDs), cold cathode fluorescent lights (CCFLs), quantum-dot based light converters, organic light-emitting diodes (OLEDs), fluorescent lights, incandescent lights, or gas discharge lights.

In an embodiment, the apparatus further comprises a controller, implemented at least in part in hardware, that is configured to regulate an amount of light illuminating an edge of the light indicator from no light to a maximum light.

In an embodiment, the light indicator is configured to illuminate an edge of the light indicator with light that traverses through one or more light guides.

In an embodiment, one or more outer surfaces of the light indicator follows a portion of a contour of one or more neighboring modules or one or more neighboring submodules.

In an embodiment, the outer surface of the movable module comprises an icon that indicates one or more user operable features of the apparatus.

In an embodiment, the apparatus further comprises a protrusion which is configured to cause the tactile switch to be depressed off-axis. In an embodiment, the protrusion is stationary relative to the stationary module. In an embodiment, the movable module is configured to cause the tactile switch to be depressed off-axis.

In an embodiment, a movable module (e.g., a high-end push button, etc.) comprises: an outer surface; a substrate; a tactile switch on a first side of the substrate; a light indicator on a second side of the substrate, the first side and the second side being opposing sides of the substrate; the movable module being configured to generate a spatial displacement relative to a stationary module along a spatial direction in response to a physical force exerted on the outer surface along the spatial direction.

In an embodiment, a method comprising: configuring, in an environment, a first microphone and a second microphone, the first microphone and the second microphone being of two different types of microphones; receiving a first audio signal comprising first microphone responses generated by the first microphone in response to sounds occurring in the environment at a given time; receiving a second audio signal comprising second microphone responses generated by the second microphone the sounds occurring in the environment at the given time; analyzing differences between the first microphone responses in the first audio signal and the second microphone responses in the second audio signal to determine a particular type of sound represented in the sounds, etc.

In various example embodiments, a system, an apparatus, or one or more other computing devices may be used to implement at least some of the techniques as described including but not limited to a method, a control, a function, a feature, etc., as described herein. In an embodiment, a non-transitory computer readable storage medium stores software instructions, which when executed by one or more processors cause performance of a method, a control, a function, a feature, etc., as described herein.

Note that, although separate embodiments are discussed herein, any combination of embodiments and/or partial embodiments discussed herein may be combined to form further embodiments.

8. Implementation Mechanisms—Hardware Overview

According to one embodiment, the techniques described herein are implemented by one or more special-purpose computing devices. The special-purpose computing devices may be hard-wired to perform the techniques, or may include digital electronic devices such as one or more application-specific integrated circuits (ASICs) or field programmable gate arrays (FPGAs) that are persistently programmed to perform the techniques, or may include one or more general purpose hardware processors programmed to perform the techniques pursuant to program instructions in firmware, memory, other storage, or a combination. Such special-purpose computing devices may also combine custom hard-wired logic, ASICs, or FPGAs with custom programming to accomplish the techniques. The special-purpose computing devices may be desktop computer systems, portable computer systems, handheld devices, networking devices or any other device that incorporates hard-wired and/or program logic to implement the techniques.

Figure 6:
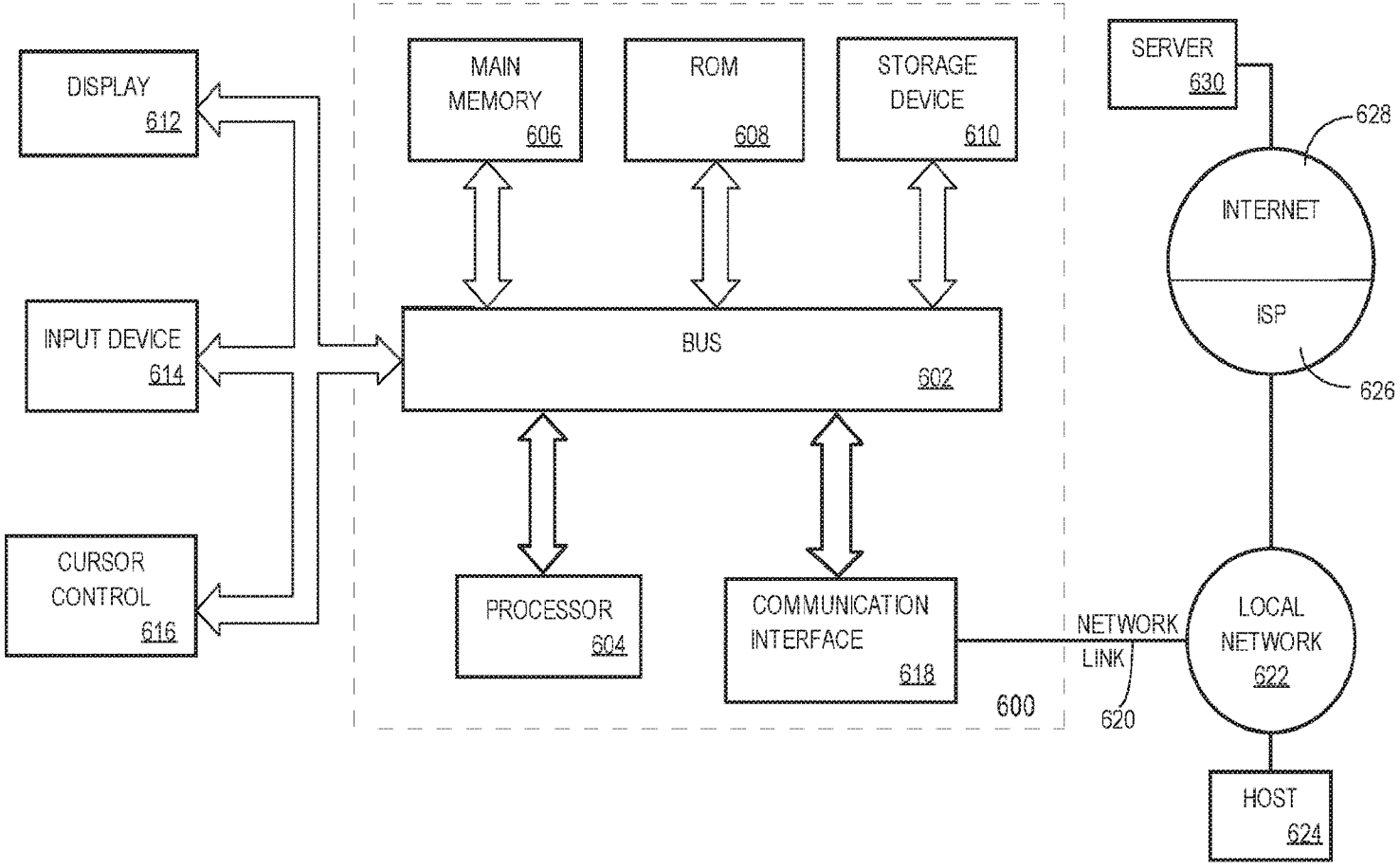
FIG. 6 illustrates an example hardware platform on which a computer or a computing device as described herein may be implemented.

For example, FIG. 6 is a block diagram that illustrates a computer system 600 upon which an example embodiment of the invention may be implemented. Computer system 600 includes a bus 602 or other communication mechanism for communicating information, and a hardware processor 604 coupled with bus 602 for processing information. Hardware processor 604 may be, for example, a general purpose microprocessor.

Computer system 600 also includes a main memory 606, such as a random access memory (RAM) or other dynamic storage device, coupled to bus 602 for storing information and instructions to be executed by processor 604. Main memory 606 also may be used for storing temporary variables or other intermediate information during execution of instructions to be executed by processor 604. Such instructions, when stored in non-transitory storage media accessible to processor 604, render computer system 600 into a special-purpose machine that is customized to perform the operations specified in the instructions.

Computer system 600 further includes a read only memory (ROM) 608 or other static storage device coupled to bus 602 for storing static information and instructions for processor 604. A storage device 610, such as a magnetic disk or optical disk, is provided and coupled to bus 602 for storing information and instructions.

Computer system 600 may be coupled via bus 602 to a display 612, such as a liquid crystal display, for displaying information to a computer user. An input device 614, including alphanumeric and other keys, is coupled to bus 602 for communicating information and command selections to processor 604. Another type of user input device is cursor control 616, such as a mouse, a trackball, touchscreen, or cursor direction keys for communicating direction information and command selections to processor 604 and for controlling cursor movement on display 612. This input device typically has two degrees of freedom in two axes, a first axis (e.g., x) and a second axis (e.g., y), that allows the device to specify positions in a plane.

Computer system 600 may implement the techniques described herein using customized hard-wired logic, one or more ASICs or FPGAs, firmware and/or program logic which in combination with the computer system causes or programs computer system 600 to be a special-purpose machine. According to one embodiment, the techniques herein are performed by computer system 600 in response to processor 604 executing one or more sequences of one or more instructions contained in main memory 606. Such instructions may be read into main memory 606 from another storage medium, such as storage device 610. Execution of the sequences of instructions contained in main memory 606 causes processor 604 to perform the process steps described herein. In alternative embodiments, hard-wired circuitry may be used in place of or in combination with software instructions.

The term "storage media" as used herein refers to any non-transitory media that store data and/or instructions that cause a machine to operation in a specific fashion. Such storage media may comprise non-volatile media and/or volatile media. Non-volatile media includes, for example, optical or magnetic disks, such as storage device 610. Volatile media includes dynamic memory, such as main memory 606. Common forms of storage media include, for example, a floppy disk, a flexible disk, hard disk, solid state drive, magnetic tape, or any other magnetic data storage medium, a CD-ROM, any other optical data storage medium, any physical medium with patterns of holes, a RAM, a PROM, and EPROM, a FLASH-EPROM, NVRAM, any other memory chip or cartridge.

Storage media is distinct from but may be used in conjunction with transmission media. Transmission media participates in transferring information between storage media. For example, transmission media includes coaxial cables, copper wire and fiber optics, including the wires that comprise bus 602. Transmission media can also take the form of acoustic or light waves, such as those generated during radio-wave and infra-red data communications.

Various forms of media may be involved in carrying one or more sequences of one or more instructions to processor 604 for execution. For example, the instructions may initially be carried on a magnetic disk or solid state drive of a remote computer. The remote computer can load the instructions into its dynamic memory and send the instructions over a telephone line using a modem. A modem local to computer system 600 can receive the data on the telephone line and use an infra-red transmitter to convert the data to an infra-red signal. An infra-red detector can receive the data carried in the infra-red signal and appropriate circuitry can place the data on bus 602. Bus 602 carries the data to main memory 606, from which processor 604 retrieves and executes the instructions. The instructions received by main memory 606 may optionally be stored on storage device 610 either before or after execution by processor 604.

Computer system 600 also includes a communication interface 618 coupled to bus 602. Communication interface 618 provides a two-way data communication coupling to a network link 620 that is connected to a local network 622. For example, communication interface 618 may be an integrated services digital network (ISDN) card, cable modem, satellite modem, or a modem to provide a data communication connection to a corresponding type of telephone line. As another example, communication interface 618 may be a local area network (LAN) card to provide a data communication connection to a compatible LAN. Wireless links may also be implemented. In any such implementation, communication interface 618 sends and receives electrical, electromagnetic or optical signals that carry digital data streams representing various types of information.

Network link 620 typically provides data communication through one or more networks to other data devices. For example, network link 620 may provide a connection through local network 622 to a host computer 624 or to data equipment operated by an Internet Service Provider (ISP) 626. ISP 626 in turn provides data communication services through the world wide packet data communication network now commonly referred to as the "Internet" 628. Local network 622 and Internet 628 both use electrical, electromagnetic or optical signals that carry digital data streams. The signals through the various networks and the signals on network link 620 and through communication interface 618, which carry the digital data to and from computer system 600, are example forms of transmission media.

Computer system 600 can send messages and receive data, including program code, through the network(s), network link 620 and communication interface 618. In the Internet example, a server 630 might transmit a requested code for an application program through Internet 628, ISP 626, local network 622 and communication interface 618.

The received code may be executed by processor 604 as it is received, and/or stored in storage device 610, or other non-volatile storage for later execution.

9. Equivalents, Extensions, Alternatives and Miscellaneous

In the foregoing specification, example embodiments of the invention have been described with reference to numerous specific details that may vary from implementation to implementation. Thus, the sole and exclusive indicator of what is the invention, and is intended by the applicants to be the invention, is the set of claims that issue from this application, in the specific form in which such claims issue, including any subsequent correction. Any definitions expressly set forth herein for terms contained in such claims shall govern the meaning of such terms as used in the claims. Hence, no limitation, element, property, feature, advantage or attribute that is not expressly recited in a claim should limit the scope of such claim in any way. The specification and drawings are, accordingly, to be regarded in an illustrative rather than a restrictive sense.

What is claimed is:

1. An apparatus comprising:

a stationary module;

a movable module having an outer surface and a substrate;

the movable module being configured to generate a spatial displacement relative to the stationary module along a spatial direction in response to a physical force exerted on the outer surface along the spatial direction, wherein the spatial direction along which the spatial displacement is made is a downward direction perpendicular to the outer surface of the movable module;

a tactile switch secured on a first side of the substrate;

a light indicator secured on a second side of the substrate, the first side and the second side being opposing sides of the substrate; and a protrusion provided on a surface portion of the stationary module opposing the tactile switch, the protrusion being configured to contact the tactile switch so as to cause it to be depressed off-axis.

2. The apparatus as claimed in claim 1, wherein the substrate is a printed circuit board (PCB) on which the tactile switch and the light indicator are mounted.

3. The apparatus as claimed in claim 1, wherein the physical force is exerted by a user in addition to a gravitational force.

4. The apparatus as claimed in claim 1, wherein the light indicator is configured to guide light from one or more active light emitters to illuminate an edge of the light indicator.

5. The apparatus as claimed in claim 1, wherein the tactile switch is configured to generate a switch state change in response to the physical force.

6. The apparatus as claimed in claim 1, wherein the light indicator is configured to generate a light indicator state change perceivable through an edge of the light indicator in response to the switch state change.

7. The apparatus as claimed in claim 1, wherein the tactile switch is located in an interior region of the movable module with no operational surface of the tactile switch exposed to direct manipulation by a user of the apparatus.

8. The apparatus as claimed in claim 1, wherein an elongated edge of the light indicator is configured to be illuminated in one or more light indicator states and is located along a perimeter of the movable module.

9. The apparatus as claimed in claim 1, wherein the stationary module includes one or more microphones for capturing sound.

10. The apparatus as claimed in claim 9, wherein the microphones are of a single type.

11. The apparatus as claimed in claim 9, wherein the microphones are of two or more different types.

12. The apparatus as claimed in claim 1, wherein one or more microphones in the stationary module switch between an on state and an off state in response to the switch state change.

13. The apparatus as claimed in claim 1, wherein an edge of the light indicator is illuminated with a color light, and wherein the edge of the light indicator remains to be illuminated with the color light after the physical force and lasts until a new physical force is exerted on the outer surface of the movable module.

14. The apparatus as claimed in claim 1, wherein the light indicator comprises a light distribution medium that is curved, and wherein the light distribution medium transports light from light emitters along a curved path to an edge of the light indicator.

15. The apparatus as claimed in claim 1, wherein the light indicator comprises a light distribution medium with reflective surfaces, and wherein the light distribution medium transports light from light emitters along a folded optical path to an edge of the light indicator.

16. The apparatus as claimed in claim 1, wherein the light indicator comprises a light transmissive medium with one or more light reflective surfaces that comprises at least one of one or more metallic surfaces or one or more non-metallic surfaces.

17. The apparatus as claimed in claim 1, wherein the apparatus represents a satellite microphone device that operates in conjunction with one or more other devices of a phone system, and wherein at least one of the other devices comprises one or more microphones configured to switch between an on state and an off state in response to a switch state change caused by the physical force.

* * * * *